United States Patent [19]

Tani et al.

[11] Patent Number: 5,029,833

[45] Date of Patent: Jul. 9, 1991

[54] RECORDING APPARATUS

[75] Inventors: Tatsuo Tani, Urayasu; Shozo Miyawaki, Urawa, both of Japan

[73] Assignee: Ricoh Company, Ltd., Tokyo, Japan

[21] Appl. No.: 330,359

[22] Filed: Mar. 29, 1989

[30] Foreign Application Priority Data

Mar. 29, 1988 [JP] Japan ..... 63-75250

[51] Int. Cl.[5] ..... B65H 3/44

[52] U.S. Cl. ..... 271/9; 355/311

[58] Field of Search ..... 271/9; 355/311, 313, 355/314

[56] References Cited

U.S. PATENT DOCUMENTS 4,809,050 2/1989 Ito ..... 271/9 X 4,849,790 7/1989 Ito ..... 271/9 X 4,881,104 11/1989 Kusumoto ..... 271/9 X

*Primary Examiner*—Richard A. Schacher

*Attorney, Agent, or Firm*—Oblon, Spivak, McClelland, Maier & Neustadt

[57] ABSTRACT

When a sheet feeder such as a cassette containing particular sheets is loaded in a recording apparatus, the sheet feeder is recognized by a particular sheet feeder recognizing device. If the sheet containing particular sheets is selected against the will of the operator, the feeding of the particular sheets from the sheet feeder is prevented by a feed stop means.

4 Claims, 11 Drawing Sheets

RECORDING APPARATUS

BACKGROUND OF THE INVENTION

The present invention relates to a recording apparatus, and more particularly to a recording apparatus for use as a copying machine, a facsimile transmitter/-receiver, a printer, or the like which has a plurality of selectable sheet feeders.

There is known a recording apparatus having a plurality of sheet feeders for storing sheets of paper of two or more different types, a recording unit for recording desired data on any of the sheets stored in the sheet feeders, and a sheet feeder selector for selecting any of the sheet feeders to supply a sheet of paper for recording data thereon.

Ordinary sheets of paper are stored in one of the sheet feeders, whereas special sheets of paper of the same size as that of the ordinary sheets are stored in another sheet feeder. The special sheets of paper include different types of paper such as drawing sheets, letterheads with the names and addresses of companies, colored sheets, transparent sheets for use in overhead projectors, postal cards, label sheets, cardboards for use as covers, etc.

Heretofore, the known recording apparatus does not have any display or indicator for indicating that such special sheets are set in a sheet feeder. Therefore, desired data may erroneously be recorded on a special sheet when they should in fact be recorded on an ordinary sheet, or conversely desired data may erroneously be recorded on an ordinary sheet when they should in fact be recorded on a special sheet.

SUMMARY OF THE INVENTION

It is an object of the present invention to provide a recording apparatus which can avoid the recording of desired data on a special sheet of recording paper that the operator does not want to be printed, and which can automatically select a sheet of the type desired by the operator for recording desired data thereon.

To accomplish the above object, a recording apparatus of the invention has an identifiable sheet feeder which stores special sheets of paper. The recording apparatus is controlled by a CPU such that when the sheet feeder containing the special sheets is erroneously selected, a sheet or sheets of paper are fed from another sheet feeder or an alarm is produced. Thus, the recording of data on a special sheet or sheets which are not wanted by the operator can be avoided beforehand.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
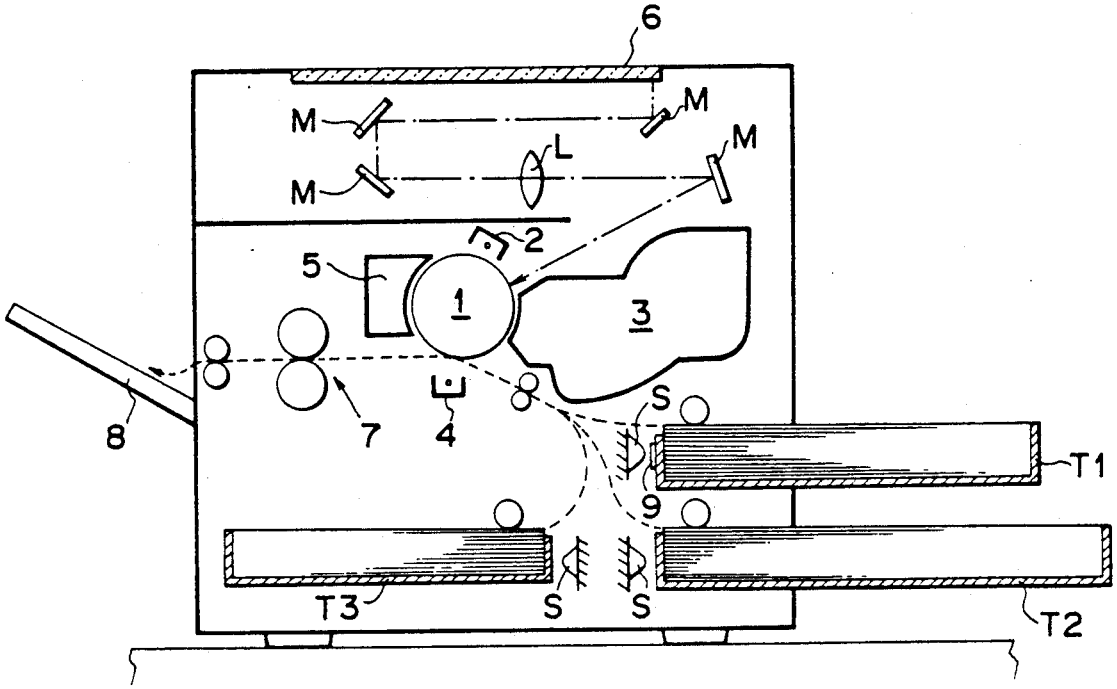
FIG. 1 is a schematic elevational view of a copying machine for use as a recording apparatus according to the present invention.

A recording apparatus according to the present invention can be employed as a copying machine with sheet feeder cassettes as shown in FIG. 1.

The copying process in the copying machine does not have direct bearing on the present invention, and the general structure of the copying machine is well known in the art. Therefore, the copying machine itself will briefly be described below.

The copying machine has a rotatable photosensitive drum 1 around which there are disposed a primary charger 2, a developing unit 3, a transfer charger 4, and a cleaning unit 5 successively in the direction in which the photosensitive drum 1 is rotatable.

Light reflected from an illuminated original (not shown) on a contact glass panel 6 is applied through an optical system composed of mirrors M and a focusing lens L to an area on the photosensitive drum 1 between the primary charger 2 and the developing unit 3. One of the mirrors M is a scanning mirror that is angularly movable back and forth in synchronism with the rotation of the photosensitive drum 1 for forming a latent image on the circumferential surface of the photosensitive drum 1.

The latent image on the photosensitive drum 1 is developed into a visible image by toner in the developing unit 3. The visible toner image is then transferred by the transfer charger 4 onto a transfer sheet of paper fed from one of sheet feeder cassettes T1, T2, T3. The transfer sheet is peeled off the drum 1, and the transferred toner image is fixed to the transfer sheet by a fixing unit 7. The sheet with the fixed image is thereafter discharged onto a discharge tray 8.

The cassettes T1, T2, T3 are removably mounted in a cassette loading region defined in a frame of the copying machine, and can store sheets of paper having various different sizes or the same size. Alternatively, ordinary sheets of paper may be stored in one of the cassettes, and special sheets of paper of the same size as that of the ordinary sheets may be stored in another cassette.

The operator can freely select one of the cassettes T1, T2, T3 loaded in the cassette loading region for supplying a desired sheet or sheets of paper to copy a desired image thereon. For example, any desired cassette can be selected by operating a first selector means or switch mounted as a sheet feeder selector means on a control panel of the copying machine. Heretofore, however, the switch may erroneously be operated to select a sheet or sheets of a type which the operator does not want to be printed.

Figure 2:
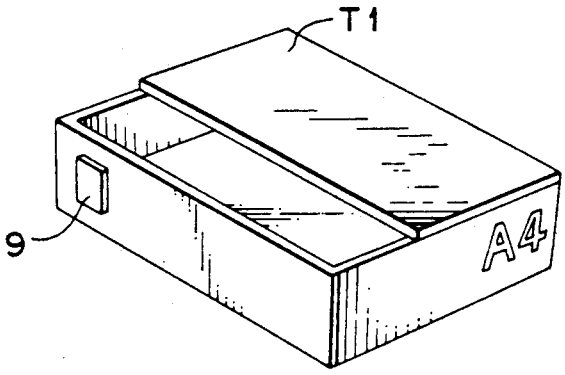
FIG. 2 is a perspective view of a sheet cassette.

According to the present invention, as shown in FIG. 2, one of the cassettes, for example, the cassette T1, which is to store special sheets of paper is used as a particular sheet feeder, and a light reflecting seal 9 is applied to a front panel of the cassette T1.

The cassette loading region in the copying machine shown in FIG. 1 has a plurality of light sensors S each composed of a light-emitting element and a light detector and attached to a frame of the copying machine in confronting relation to the respective cassettes loaded in the cassette loading region. The particular cassette T1 storing special sheets of paper and loaded in the cassette loading region can thereby be detected by the corresponding light sensor S through the detection of light reflected by the seal 9.

The light sensor S and the light reflecting seal 9 serve as a particular sheet feeder recognizing means.

Figure 3:
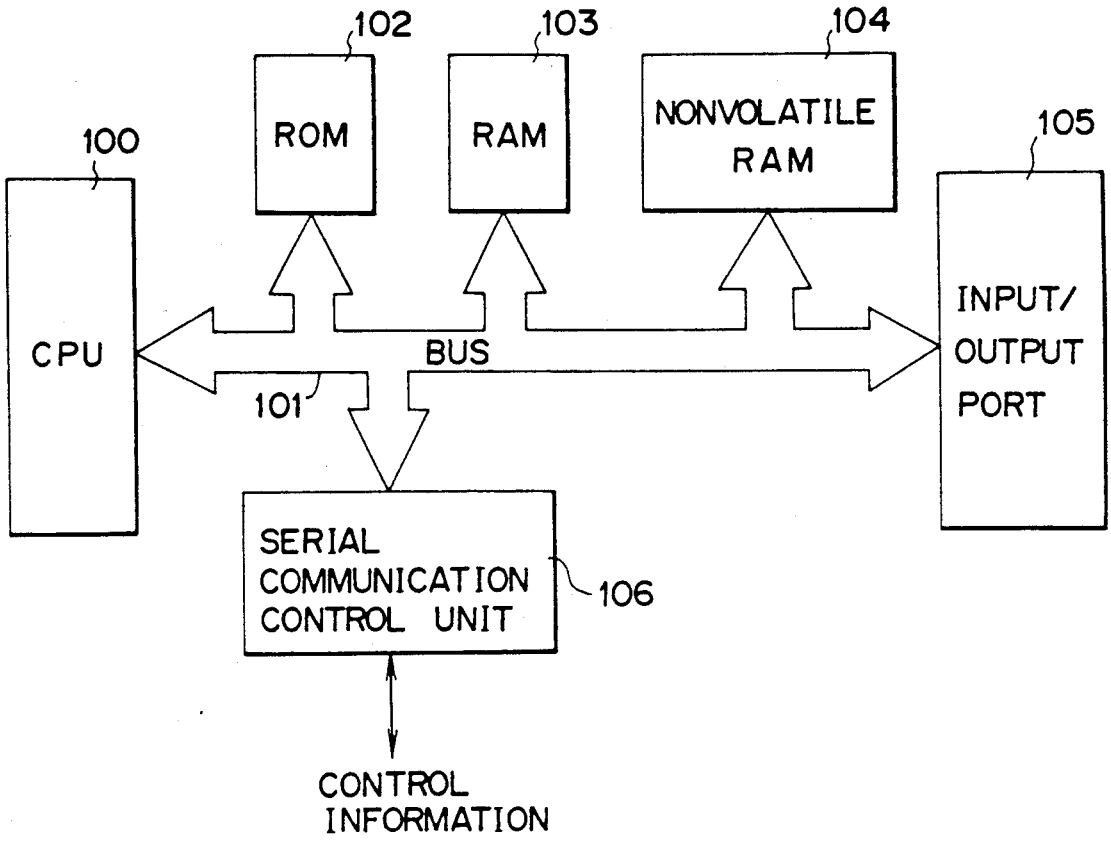
FIG. 3 is a block diagram of a controller in the recording apparatus.

FIG. 3 shows a controller used for controlling the copying machine. The particular sheet feeder recognizing means and the first selector means can be controlled by the controller through a serial communication control unit 106.

The controller shown in FIG. 3 includes microprocessor or central processing unit (CPU) 100 for executing a program for operating the copying machine, address, data, and control buses 101 connected to the CPU 100, a ROM 102, a RAM 103, a nonvolatile RAM 104 which are connected to the control bus, and an input/output port 105 connected to the CPU 100 for outputting signals to motors, solenoids, clutches, etc., and receiving signals from various sensors.

When a cassette selected by the first selector means is the particular cassette T1, the CPU 100 detects that a sheet or sheets of paper are about to be fed from the particular cassette T1 based on information from the first selector means or the sheet feeder selector means and the particular sheet feeder recognizing means. Then, the CPU energizes a first feed stop means such as an alarm device to prevent a sheet or sheets from being fed from the particular cassette. This control function is effected as the control function of a first feed stop control means, and hence the CPU 100 also serves as the first feed stop control means.

Figure 4:
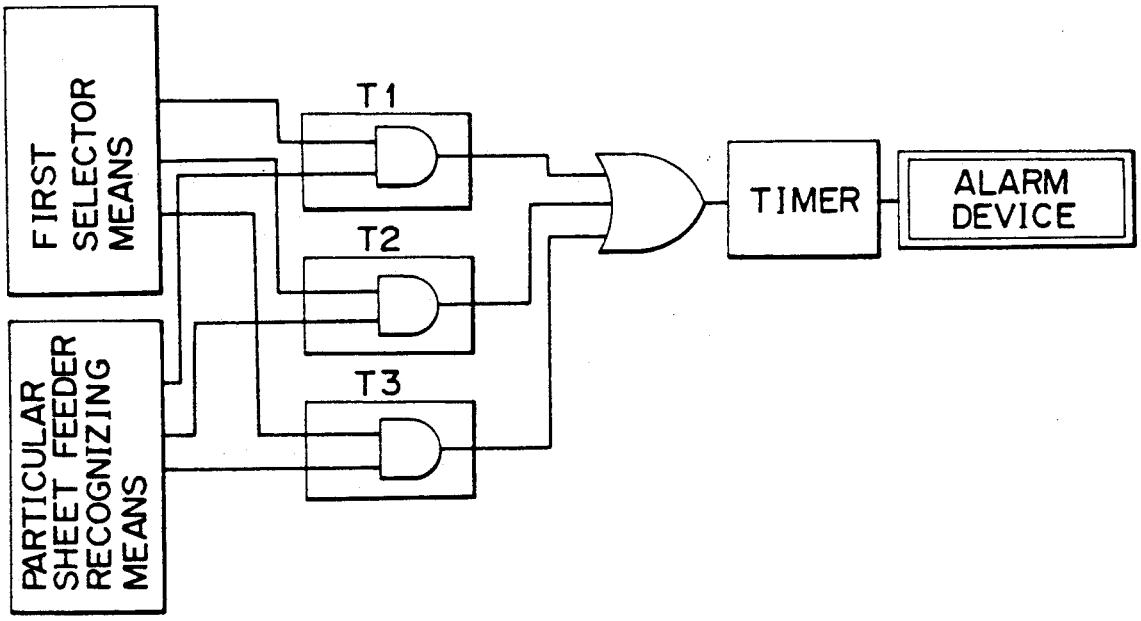
FIG. 4 is a block diagram of a control system in the controller shown in FIG. 3.
Figure 5:
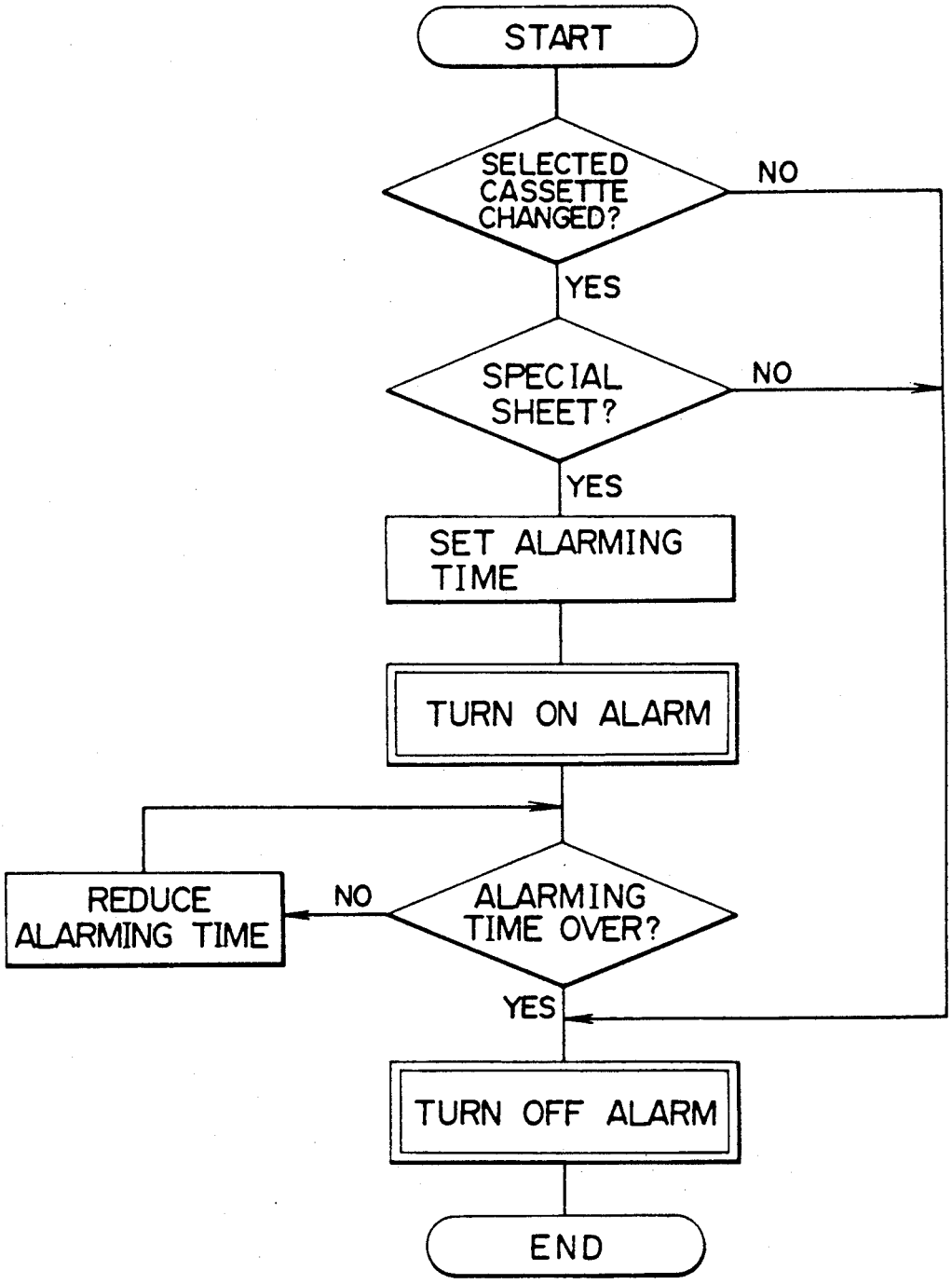
FIG. 5 is a flowchart of a control sequence of the control system shown in FIG. 4.

A control sequence for generating an alarm under the control of the first feed stop control means will be described below with reference to FIGS. 4 and 5.

When a cassette selected from the cassettes T1, T2, T3 is the particular cassette storing special sheets of paper, an alarm sound is generated by the alarm device for a certain period of time.

The alarm sound thus produced informs the operator of the fact that a sheet or sheets of a type the operator does not want to be printed are about to be supplied, and urges the operator to selector another cassette. The machine does not specifically know whether or not sheets selected by an operator is what the operator desires. When an operator selects a particular sheet the alarm is emitted to the operator so as to notify the operator of a selection of a particular sheet other than a standard sheet (i.e., a nonstandard sheet). This is done because the operator may inadvertently select a nonstandard sheet in place of the ordinary sheet.

Since particular or non-standard sheets by definition are not used as often to make copies the alarm is useful to prevent the copying on undesired nonstandard sheets which may be more expensive than ordinary sheets and in any event any copies made on the inappropriate sheets are wasteful.

If it is necessary to identify sheets of plural types, then different alarm sounds such as of different pitches may be generated by the alarm device. Alarms in other forms than sound, such as a visible alarm in the form of flickering light produced by an indicator on the control panel, and other stimuli that can be sensed by the operator may be employed.

The particular sheet feeder recognizing means is not limited to the light reflecting seal and the light sensor, but may be any of other known means such as a projection or a recess on the particular cassette and a sensor for mechanically detecting the projection or the recess.

Figure 6:
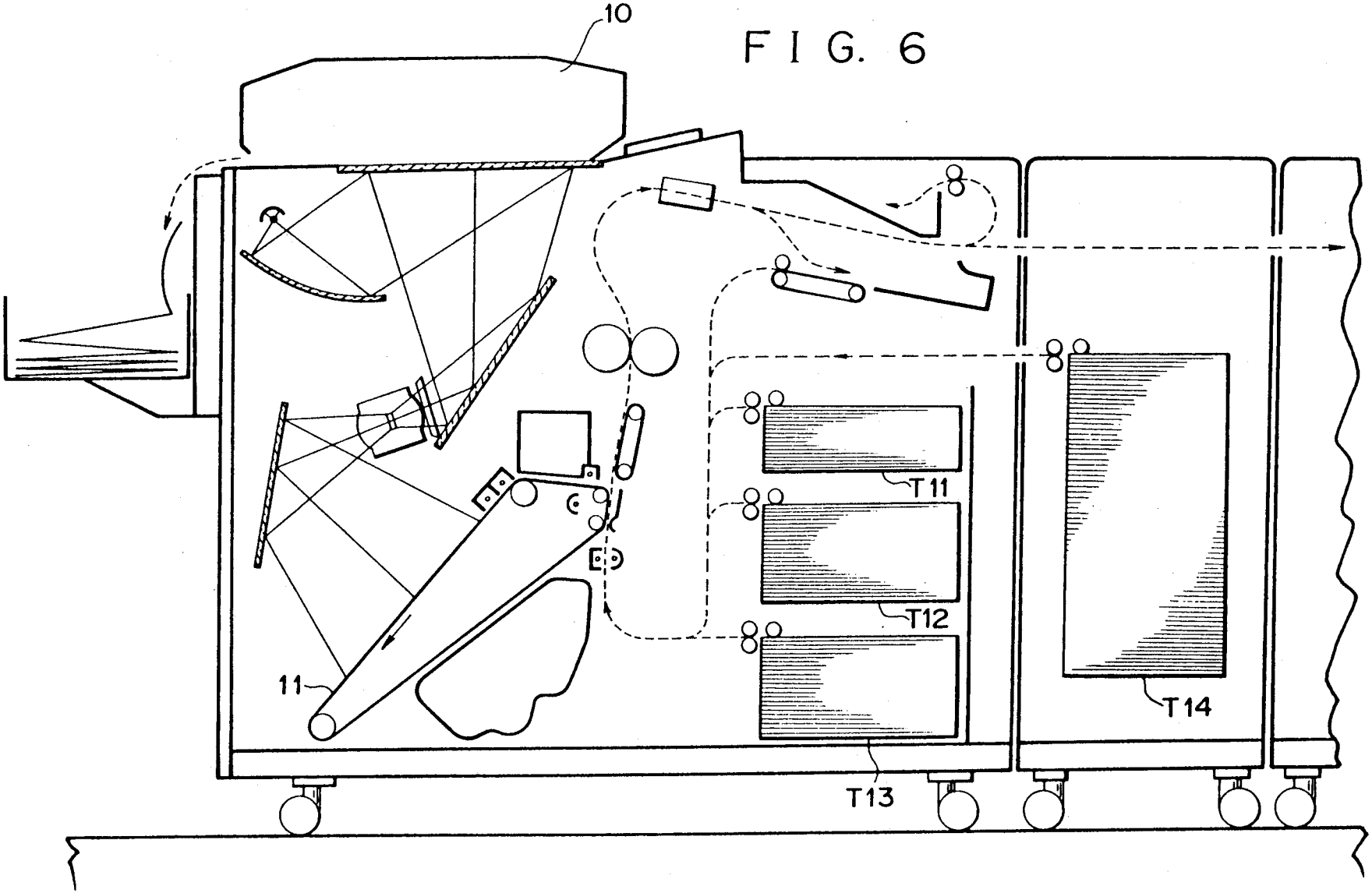
FIG. 6 is a schematic elevational view of another copying machine that can be used as the recording apparatus of the present invention.

FIG. 6 shows another copying machine employed as the recording apparatus according to the present invention.

The copying machine of FIG. 6 is basically the same as the copying machine shown in FIG. 1, but is different therefrom in that it has an automatic document feeder (ADF) 10 for automatically feeding originals to be copied, a photosensitive belt 11, and sheet feeders in the form of trays T11, T12, T13 and a larger-capacity tray T14. These trays T11, T12, T13, T14 are fixedly mounted in the frame of the copying machine, and hence the particular sheet feeder recognizing means cannot comprise light sensors and associated light reflecting seals. The particular sheet feeder recognizing means in the copying machine shown in FIG. 6 comprises electric selector switches on the control panel which are manually operated by the operator when sheets are stored in the trays, to send signals to the serial communication control unit 106 shown in FIG. 3.

Figure 7:
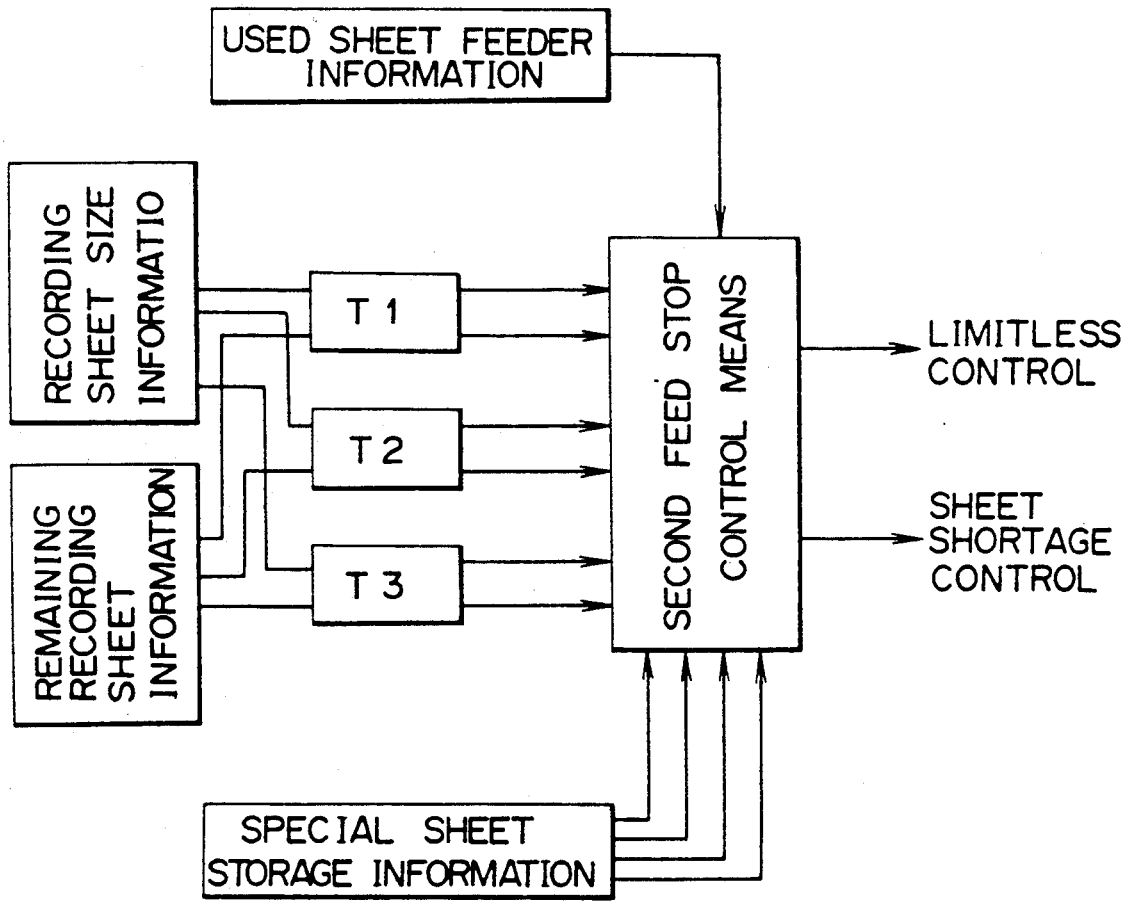
FIG. 7 is a block diagram of a control system in the recording apparatus shown in FIG. 6.
Figure 8:
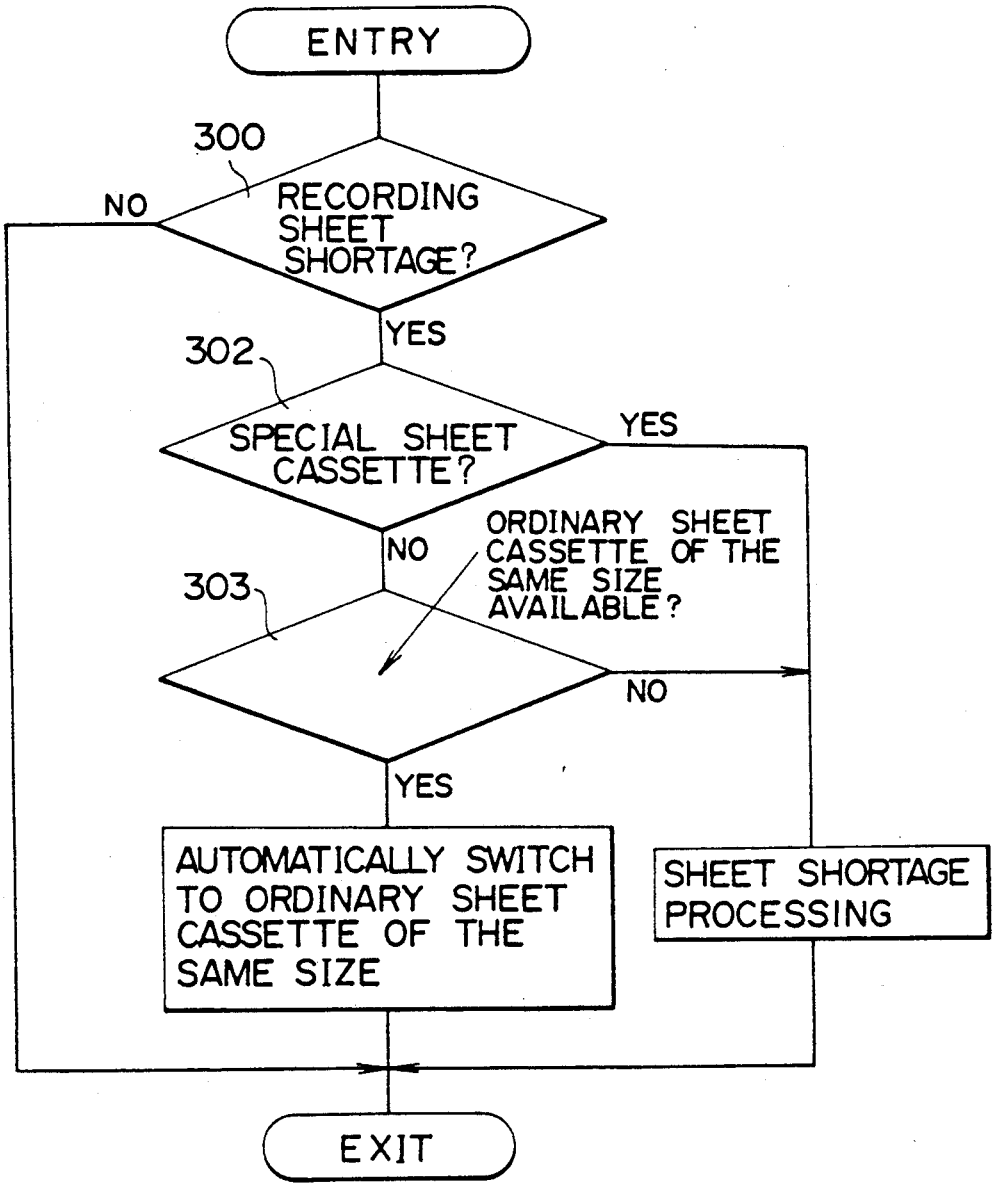
FIG. 8 is a flowchart of a control sequence of the control system shown in FIG. 7.

FIGS. 7 and 8 show another embodiment of the present invention. In this embodiment, a second selector means is added as a sheet feeder selector means for feeding sheets in a limitless control mode, i.e., for feeding sheets automatically from another cassette when the selected cassette runs short of sheets.

In FIG. 7, information from the particular sheet feeder recognizing means is supplied as used sheet feeder information and special sheet storage information, and also recording sheet size information and remaining recording sheet information are supplied as control information with respect to each of the cassettes T1, T2, T3, to a second feed stop control means.

The function of the second feed stop control means is performed by the controller, i.e., the CPU 100, shown in FIG. 3. In response to the control information, the second feed stop control means determines whether a second feed stop means (described later) is to be operated or not, and controls the second feed stop means as required.

When a cassette selected by the second selector means is the particular cassette storing special sheets of paper, the second feed stop means prevents the special sheets from being fed from the particular cassette, and either feeds sheets in a limitless control mode, i.e., from another cassette, or shuts off the copying machine in a sheet shortage control mode. The second feed stop means is also functionally implemented by the controller shown in FIG. 3.

When the second selector means selects the particular cassette, the second feed stop means is operated by the second feed stop control means in order to avoid recording of data on special sheets which would otherwise be fed from the particular cassette.

A specific control sequence of the control system shown in FIG. 7 will be described with reference to FIG. 8.

A step 300 checks remaining sheets in a cassette being used. If no sheet is available in the cassette, then control goes to a next step 302, which determines whether the cassette in use stores special sheets or not. If it stores special sheets, then the second selector means is not operated, i.e., automatic switching to another cassette is not effected, and sheet shortage processing is performed.

If the cassette in use stores ordinary sheets, then control goes to a step 303 which searches for a cassette containing ordinary sheets of the same size as that of the sheets that have been used, and, if such a cassette is available, automatically switches to that cassette for continuous sheet feeding. If not such cassette is available, then the sheet shortage processing is performed, and the copying machine is shut off.

In the control sequence of FIG. 8, ordinary sheets are to be used, and use of special sheets is to be avoided. Actually, however, there is a demand to use special sheets and avoid use of ordinary sheets.

Figure 9:
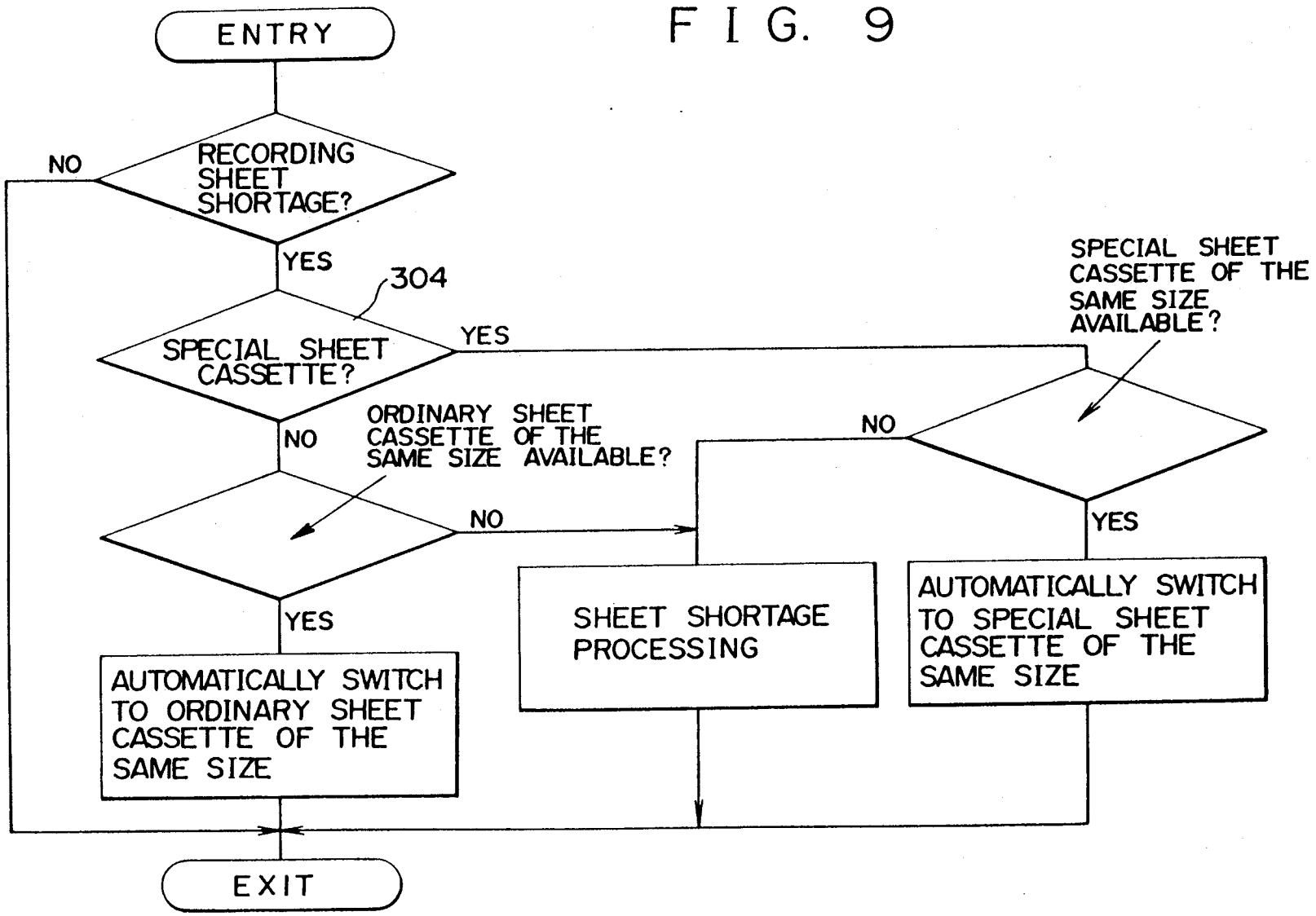
FIG. 9 is a flowchart of a modified control sequence.

Both such a demand and the process of FIG. 8 can be met by executing the flowchart of FIG. 9. According to the control sequence shown in FIG. 9, a step 304 determines whether a cassette being used stores special sheets or not. If the cassette being used is an ordinary sheet cassette, then a subsequent process is carried out with respect to ordinary sheets, and if the cassette being used is a special sheet cassette, then a subsequent process is carried out with respect to special sheets.

Figure 10:
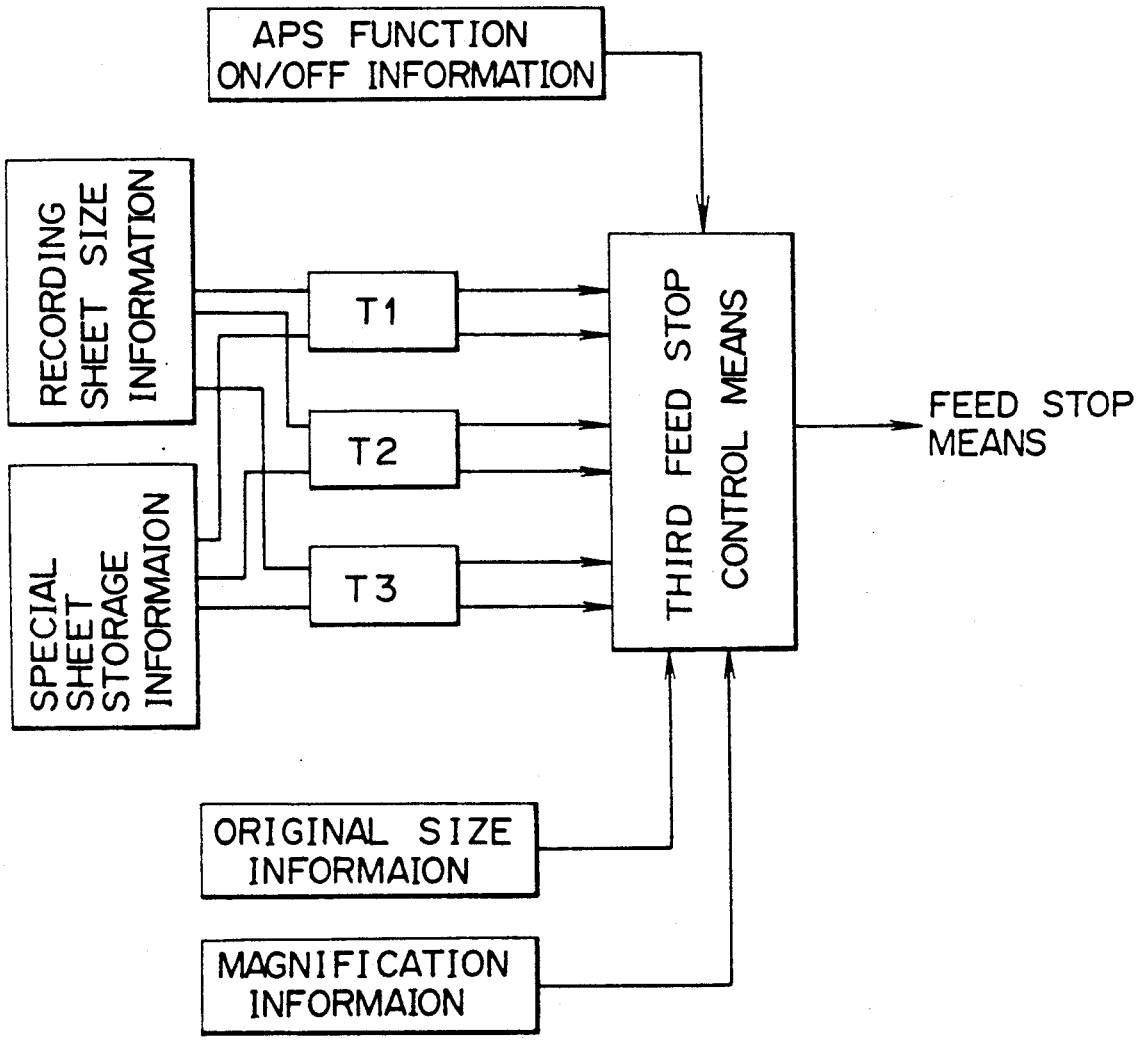
FIG. 10 is a bock diagram of a control system according to still another embodiment of the present invention.
Figure 11:
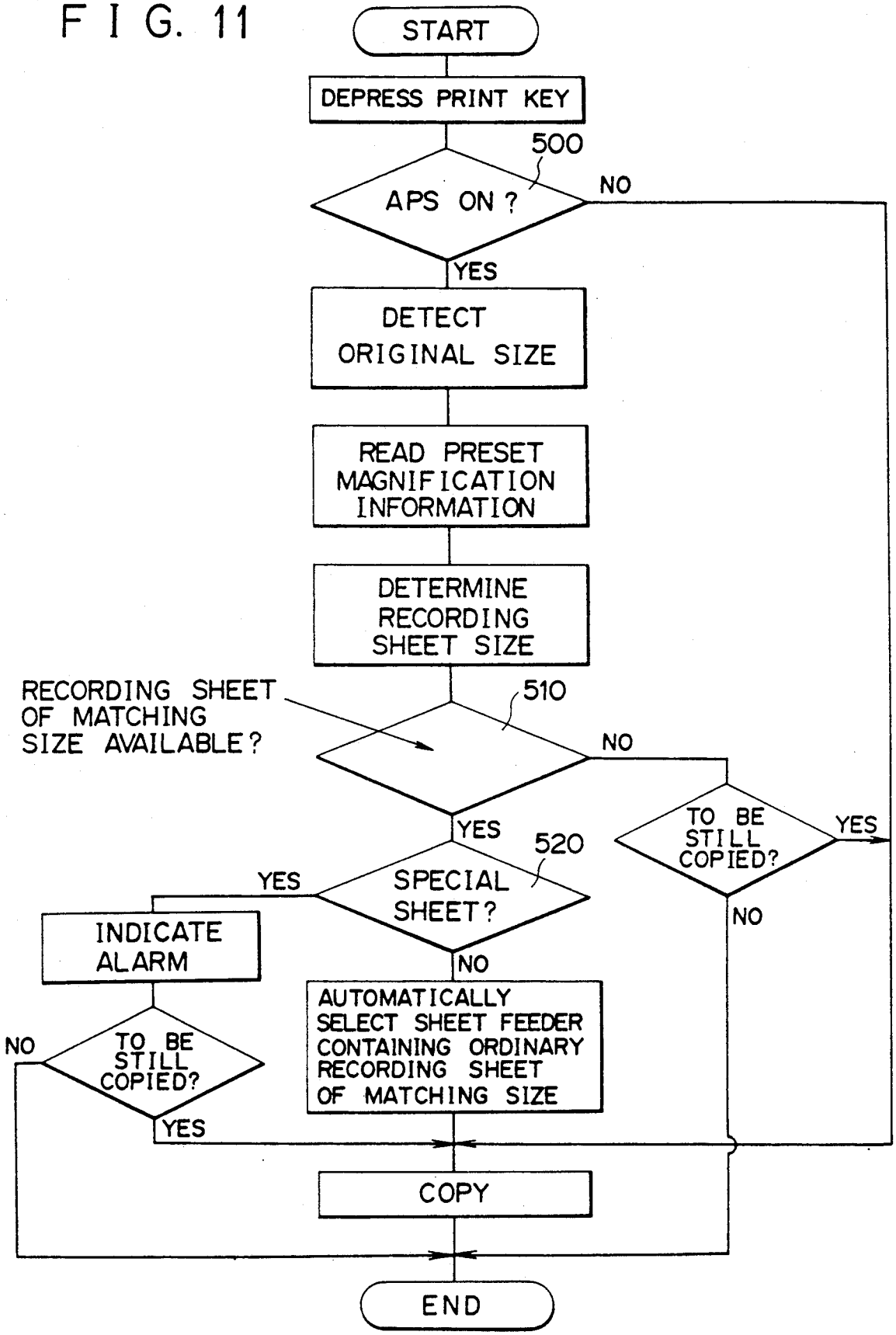
FIG. 11 is a flowchart of a control sequence of the control system illustrated in FIG. 10.

Still another embodiment of the present invention is shown in FIGS. 10 and 11. According to this embodiment, there is added as the sheet feeder selector means a third selector means having an automatic paper selection (APS) function (matching size sheet feeding function) for automatically selecting a cassette storing sheets of a size matching the size of an image to be recorded. When a cassette selected by the third selector means is the particular cassette, a third feed stop means prevents sheets from being fed from the particular cassette. In response to information from the third selector means and the particular sheet feeder recognizing means, the third feed stop means is operated by a third feed stop control means. The third feed stop means and the third feed stop control means are functionally implemented by the controller shown in FIG. 3.

Input information is applied to the third feed stop control means as shown in FIG. 10. The input information includes "APS function on/off information" indicative of whether the APS function of the third selector means is effective (on) or ineffective (off), "original size information" indicating the size of an original to be copied, "magnification information" indicating whether the original is to be copied in an enlarged or reduced scale, "recording sheet size information" indicating the sizes of sheets stored in the cassettes, and "special sheet storage information" representing whether there is a particular cassette or not. These items of information correspond to the control information in FIG. 3.

The third feed stop control means controls the third feed stop means to stop the feeding of sheets based on the control information.

A control sequence is carried out by the third feed stop control means as shown in FIG. 11. A step 500 determines whether the APS function is effective or ineffective. If it is effective, then the size of matching recording sheets is determined based on detected original size information and preset magnification information.

Then, a step 510 determines whether recording sheets of the matching size are stored in any cassette or not. If stored, that cassette is automatically selected if the stored sheets are not special sheets in a step 520, and a copying process is performed.

If the recording sheets are special sheets in the step 520, then the third feed stop control means commands the third feed stop means to indicate an alarm.

In this case, the starting of the copying process may be interrupted, and if the recording sheets may be special sheets, then a print key may be depressed again to start the copying process.

Another function for disabling the APS function if the recording sheets are special sheets may be added, and that function may be performed by depressing a key provided for that function.

Where special sheets are used only in a limited period of time of the year, a function may be added for disabling the APS function only during that limited period of time.

Figure 12:
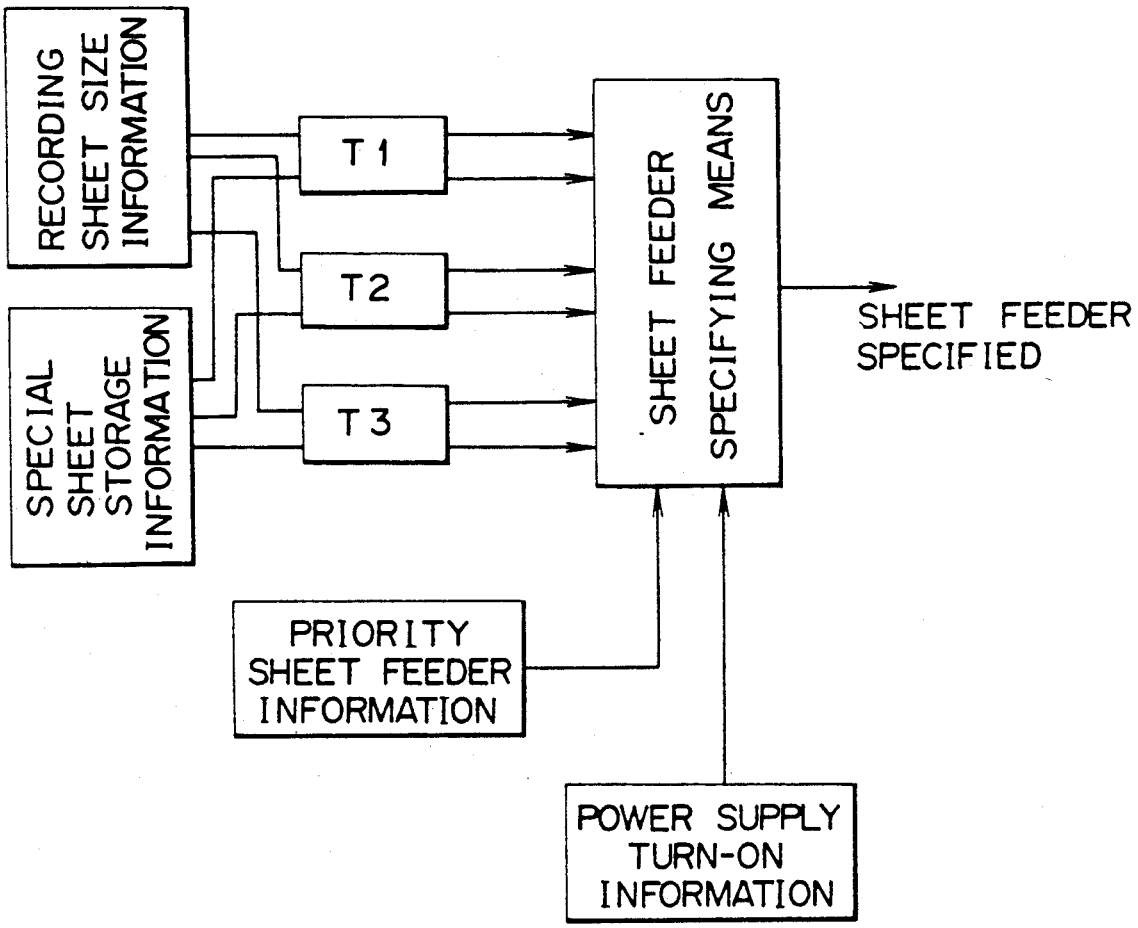
FIG. 12 is a block diagram of a control system according to a further embodiment of the present invention.
Figure 13:
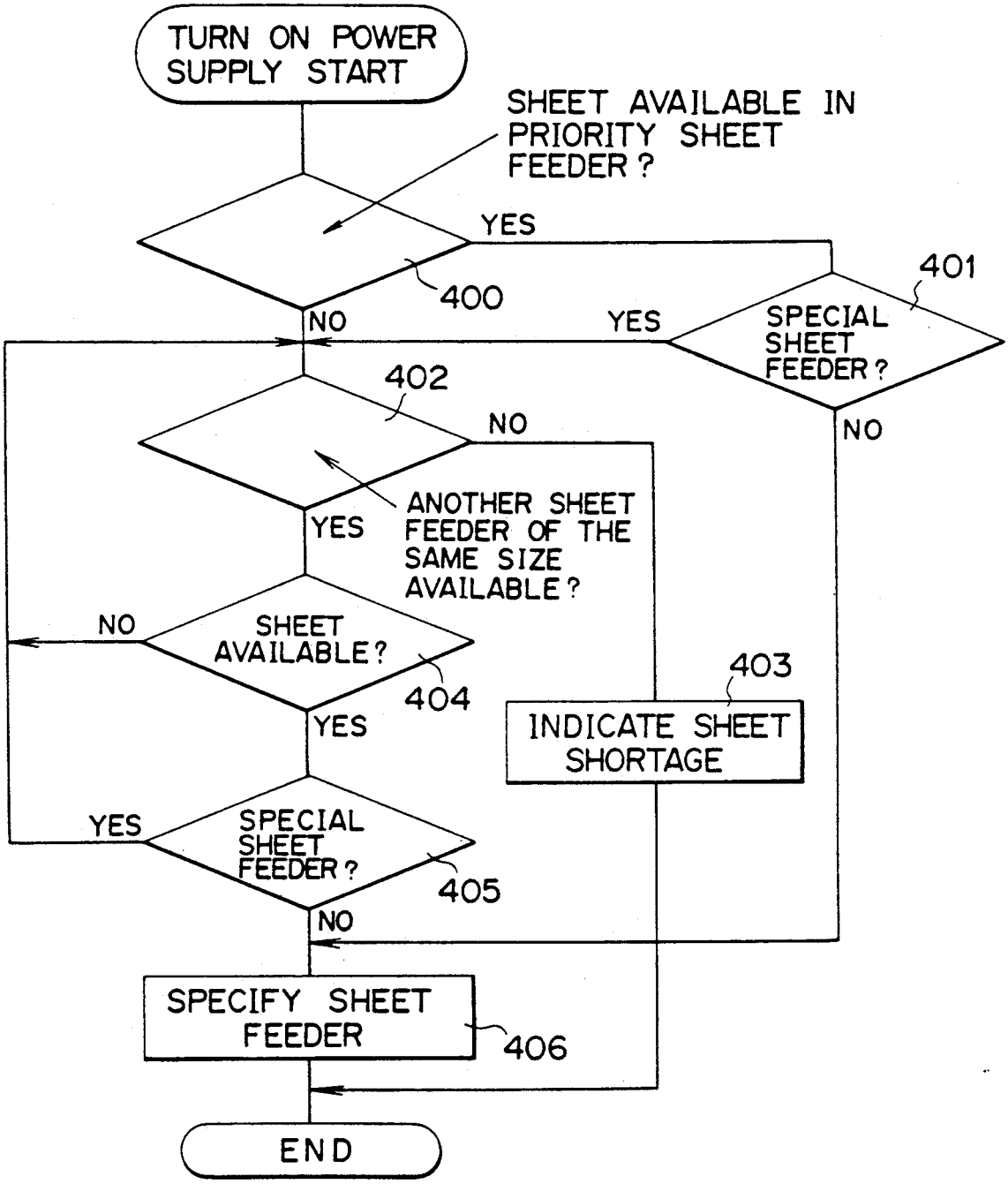
FIG. 13 is a flowchart of a control sequence of the control system shown in FIG. 12.

FIGS. 12 and 13 illustrate a further embodiment of the present invention. According to this embodiment, the sheet feeder selector means comprises a fourth selector means for automatically selecting a cassette which has been determined in advance as a priority cassette.

In FIG. 12, information from the particular sheet feeder recognizing means is supplied as recording sheet size information and special sheet storage information, and also remaining recording sheet information are supplied as control information with respect to each of the cassettes T1, T2, T3, to a sheet feeder specifying means.

The sheet feeder specifying means is also supplied with, as control information, power supply turn-on information and priority sheet feeder information indicative of a cassette which has been determined in advance as being selected with priority.

The sheet feeder specifying means includes the fourth selector means and also a fourth feed stop means.

When the cassette indicated by the priority sheet feeder information is the same as the cassette indicated by the special sheet storage information, the fourth feed stop means excludes that cassette from a range of cassettes which can automatically be selected by the fourth selector means. The sheet feeder specifying means, and the fourth selector means and the fourth feed stop means included therein, are functionally implemented by the controller shown in FIG. 3 for finally determining a cassette or sheet feeder.

A specific control sequence executed by the sheet feeder specifying means will be described with reference to FIG. 13.

A step 400 determines whether sheets are available in a priority cassette or sheet feeder indicated by the priority sheet feeder information. If available, a step 401 determines whether the sheet feeder contains special sheets or not. If not special sheets, then that the sheet feeder is specified in a step 406. If special sheets, then control goes to a step 402.

If no sheets are available in the step 400, then control goes to the step 402 which determines whether there is available another cassette or sheet feeder containing sheets of of the same size or not. If not available, a sheet shortage is indicated in a step 403.

If there is a sheet feeder for containing sheets of the same size in the step 402, then a step 404 determines whether sheets are stored in that sheet feeder or not. If not stored, then control goes back to the step 402. If stored, then a step 405 determines whether that sheet feeder is a special sheet feeder or not. If it is a special sheet feeder, then control returns to the step 402, and if not, then that sheet feeder is specified in the step 406.

The above function of excluding a sheet feeder containing special sheets from a range of automatically selectable sheet feeders may be deleted by another means in order to meet a different need of users. Alternatively, to meet the demand of a user who uses special sheets only in a limited period of time, the above function may be performed only during that limited period of time.

Although certain preferred embodiments have been shown and described, it should be understood that many changes and modifications may be made therein without departing from the scope of the appended claims.

We claim:

1. A recording apparatus comprising:

a plurality of sheet feeders for storing sheets of paper of two or more different types:

recording means for recording desired data on any of the sheets stored in the sheet feeders;

sheet feeder selector means for selecting any of the sheet feeders to supply a sheet of paper for recording data thereon, said sheet feed selector means comprising first selector means which is manually operable;

means for indicating sheet feeders storing particular sheets;

a particular sheet feeder recognizing means for recognizing one said sheet feeders which contains particular sheets among said sheets of paper of different types;

first feed stop means for preventing the particular sheets from being fed from said one sheet feeder when said one sheet feeder is selected by said first selector means;

alarm means for notifying selection of a particular sheet when said first fed stop means operates;

first feed stop control means for operating said fist feed stop means in response to information from said sheet feeder selector means and said particular sheet feeder recognizing means; and a print button for starting a copying process after a certain period of time following the operation of said alarm means.

2. A recording apparatus according to claim 1, wherein limitless sheet feeding is performed among particular sheet feed means when said print key is operated after the operation of said alarm means.

3. A recording apparatus according to claim 1, wherein said sheet selector means automatically determines limitless sheet feeding or selection of ordinary size sheets, or which one of said sheet feeders should be operated with preference.

4. A recording apparatus comprising:

a plurality of sheet feeders for storing sheets of paper of two or more different types;

recording means for recording desired data on any of the sheets stored in the sheet feeders;

sheet feeder selector means for selecting any of the sheet feeders to supply a sheet of paper for recording data thereon, said sheet feed selector means comprising first selector means which is manually operable and is able to select size and kind of sheets;

particular sheet feeder recognizing means for recognizing one of said sheet feeders which contains particular sheets among said sheets of paper of different types;

second fed stop means for preventing the ordinary sheets from being fed from said one sheet feeder when the particular sheets are selected by said sheet feeder selector means, and for enabling limitless feeding of the particular sheets from another particular sheet feeder when the selected particular sheet feeder runs short of sheets.

* * * * *